US009168453B2

(12) United States Patent
Handstein

(10) Patent No.: US 9,168,453 B2
(45) Date of Patent: Oct. 27, 2015

(54) PUZZLE AND ITS MANUFACTURING PROCESS

(71) Applicant: Hape International (Hong Kong) Limited, Kowloon (HK)

(72) Inventor: Peter Handstein, Lucerne (CH)

(73) Assignee: Hape International (Hong Kong) Limited, Hong Kong (HK)

( * ) Notice: Subject to any disclaimer, the term of this patent is extended or adjusted under 35 U.S.C. 154(b) by 111 days.

(21) Appl. No.: 13/972,784

(22) Filed: Aug. 21, 2013

(65) Prior Publication Data

US 2014/0070488 A1 Mar. 13, 2014

(30) Foreign Application Priority Data

Sep. 12, 2012 (HK) ..... 12108947.3

(51) Int. Cl.
*A63F 9/10* (2006.01)

(52) U.S. Cl.
CPC ..... *A63F 9/10* (2013.01); *A63F 2009/1072* (2013.01)

(58) Field of Classification Search
CPC ..... A63F 9/10; A63F 2009/1005; A63F 2009/1083; A63F 2009/1088; B62D 1/03; B62D 1/035
See application file for complete search history.

(56) References Cited

U.S. PATENT DOCUMENTS

| | | | | | |
|---|---|---|---|---|---|
| 1,948,962 | A * | 2/1934 | Decker | 273/157 R |
| 2,712,169 | A * | 7/1955 | Buttress | 156/347 |
| 3,585,830 | A * | 6/1971 | Mitchell | 72/203 |
| 3,595,111 | A * | 7/1971 | Hershberger | 83/19 |
| 4,362,078 | A * | 12/1982 | Ohnishi et al. | 83/862 |
| 5,826,471 | A * | 10/1998 | Iguchi | 83/51 |
| 5,842,697 | A * | 12/1998 | Scott et al. | 273/157 R |
| 5,988,687 | A * | 11/1999 | Krisch | 273/157 R |
| 6,141,851 | A * | 11/2000 | Reinbold, Jr. | 29/412 |
| 6,475,878 | B1 * | 11/2002 | Slepcevic | 438/460 |
| 7,677,568 | B1 * | 3/2010 | Kurtz | 273/157 R |
| 2002/0093137 | A1 * | 7/2002 | Enko | 273/150 |
| 2002/0105138 | A1 * | 8/2002 | Juenger | 273/157 R |
| 2009/0200199 | A1 * | 8/2009 | Biglands | 206/579 |
| 2010/0194041 | A1 * | 8/2010 | Salgado | 273/157 A |
| 2011/0193289 | A1 * | 8/2011 | Chuang et al. | 273/156 |
| 2012/0132046 | A1 * | 5/2012 | Supe-Dienes | 83/51 |
| 2014/0246832 | A1 * | 9/2014 | Yoshida | 273/156 |

* cited by examiner

*Primary Examiner* — Steven Wong
(74) *Attorney, Agent, or Firm* — Gloria Tsui-Yip, Esq.; Miskin & Tsui-Yip LLP

(57) ABSTRACT

A puzzle having a plurality of jigsaw puzzle elements; the jigsaw puzzle element having a first pressure cutting member, a second pressure cutting member, and a fracturing member which is arranged between the first and second pressure cutting members and the first and second pressure cutting members being mounted to opposing face of the fracturing member.

15 Claims, 3 Drawing Sheets

PUZZLE AND ITS MANUFACTURING PROCESS

TECHNICAL FIELD

The present invention relates to a puzzle and its manufacturing process. Specifically, the present invention relates to a jigsaw puzzle and the method for manufacturing the jigsaw puzzle.

BACKGROUND ART

Originally, the existing technology of constructing a puzzle covering a plurality of jigsaw puzzle elements is formed through cutting a jigsaw puzzle board by a set of cutting tools. After division, a plurality of jigsaw puzzle pieces are assembled or matched in such a way that the patterns on the board are recovered or to be formed as the other shapes. In the existing technology, the first side of a jigsaw puzzle board is forced to be cut by the cutting tools to form a plurality of jigsaw puzzle pieces and such a jigsaw puzzle piece having a curved face on the side edge face is formed through the cutting process. However, the sharp edges are often appeared at the second side of the jigsaw puzzle piece due to non-cutting action of the cutting tools. The existence of sharp edges would cause inconvenience to assemble or match two or more jigsaw puzzle pieces, it would also cut the user's hands. In addition, the jigsaw puzzle board cannot be completely cut by the cutting tools during the cutting process. The remaining portion that holds the jigsaw puzzle pieces together are required to be broken up by the user such that the fracturing region of the second side of the jigsaw puzzle pieces easily causes injury to the user.

CONTENTS OF THE INVENTION AND CREATION

It is an object of the present invention to provide a safe and user friendly puzzle that improves the construction of the existing puzzle and the manufacturing process of making puzzle of the present invention.

Said jigsaw puzzle element comprising a first pressure cutting member, a second pressure cutting member, and a fracturing member which is arranged between the said first and second pressure cutting members; and the said first and second pressure cutting members being mounted to opposing faces of the said fracturing member.

Typically, the said first and second pressure cutting members both comprise at least one pressure cutting layer.

Typically, the said first pressure cutting member has substantially the same thickness as the said second pressure cutting member, the said jigsaw puzzle element comprises patterns being arranged on the opposing faces of the said jigsaw element, at least two of the jigsaw puzzle elements have two corresponding patterns adapted for forming a continuous pattern.

Typically, the said fracturing member is made of paper, the said pressure cutting layer is made of wood.

Typically, the said pressure cutting layer of the said first pressure cutting member has substantially the same direction of the grain pattern as the direction of the grain pattern of the said pressure cutting layer of the said second pressure cutting member.

Typically, an arc portion of the said jigsaw puzzle element is arranged on a side edge face of the said jigsaw puzzle element, the diameter of the said arc portion is between 1 mm and 3 mm.

Typically, the said arc portions are arranged on the two side edge faces of the opposing faces of the said jigsaw puzzle element.

Typically, the said fracturing member has a thickness between 0.2 mm and 1 mm.

Typically, the said first or second pressure cutting member comprises at least two pressure cutting layer, the directions of grain patterns of the at least two pressure cutting layer are arranged in relatively different directions.

Typically, the said pressure cutting layer is made of plastic.

Typically, the said fracturing member is made of plastic.

Typically, the said pressure cutting layer is made of plywood.

Typically the said fracturing members of at least two of the said jigsaw puzzle elements are mounted with each other.

Typically, the mounting region of the said fracturing member being arranged between two fracturing members has a thickness between 0.02 mm and 0.2 mm.

Typically, a method for manufacturing the jigsaw puzzle comprising the steps of using first and second cutting tools; arranging the said first and second cutting tools at two opposing positions toward two opposing faces of a jigsaw puzzle board; and allowing the said first and second cutting tools to move towards and backwards with each other in order to cut off the said jigsaw puzzle board into a plurality of jigsaw puzzle elements during the cutting process.

Typically, a space is arranged between cutter edges of the said first and second cutting tools during the cutting process.

Typically, the said first and second cutting tools are adapted to cut off two opposing portions of the jigsaw puzzle board, the length of the said space is between 0.02 mm and 0.2 mm, the said pressure cutting member of the said jigsaw puzzle board and a first portion of the said fracturing member are being cut off during the cutting process made by the said first and second pressure cutting tools, a second portion of the said fracturing member has a thickness between 0.02 mm and 0.2 mm.

Typically, the said first and second pressure cutting members and the said fracturing member are arranged in a thickness-wise direction, the said first and second cutting tools are adapted to cut off the said first and second pressure cutting members into a plurality of the said jigsaw puzzle elements.

Typically, the angle of the said cutting edge of the said first or second cutting tool has a substantially linear relationship with the angle of the said arc portion of the said jigsaw puzzle element.

Typically, the side edge of the said first and second cutting tools of the said first or second cutting tool has a concave curved face which is adapted to coordinate with the said side edge face of the said jigsaw puzzle element.

DESCRIPTION OF FIGURES

This and other objects, features and advantages of the present invention will become apparent upon reading of the following detailed descriptions and drawings, in which.

MODE OF CARRYING OUT THE INVENTION AND CREATION

An embodiment of the present invention is described with reference to FIGS. 1 to 3.

Figure 1:
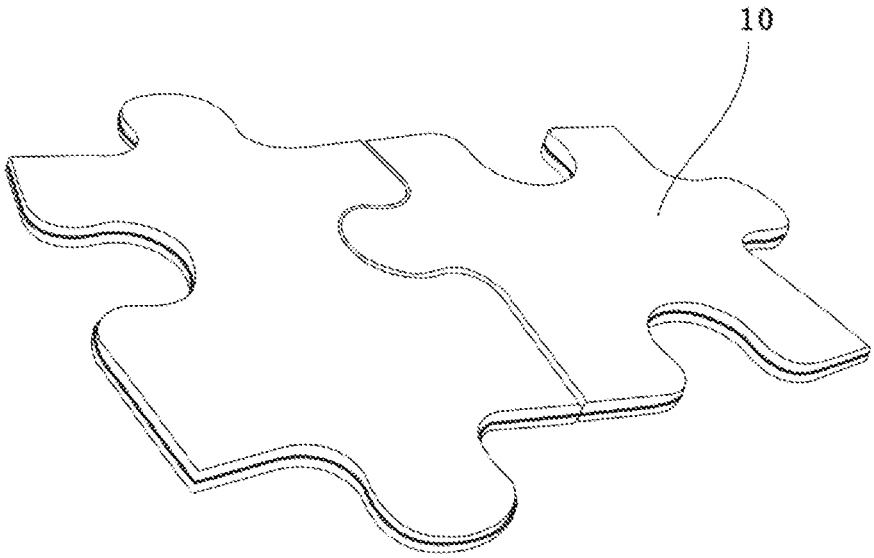
FIG. 1 shows a perspective view of an embodiment of the present invention.
Figure 2:
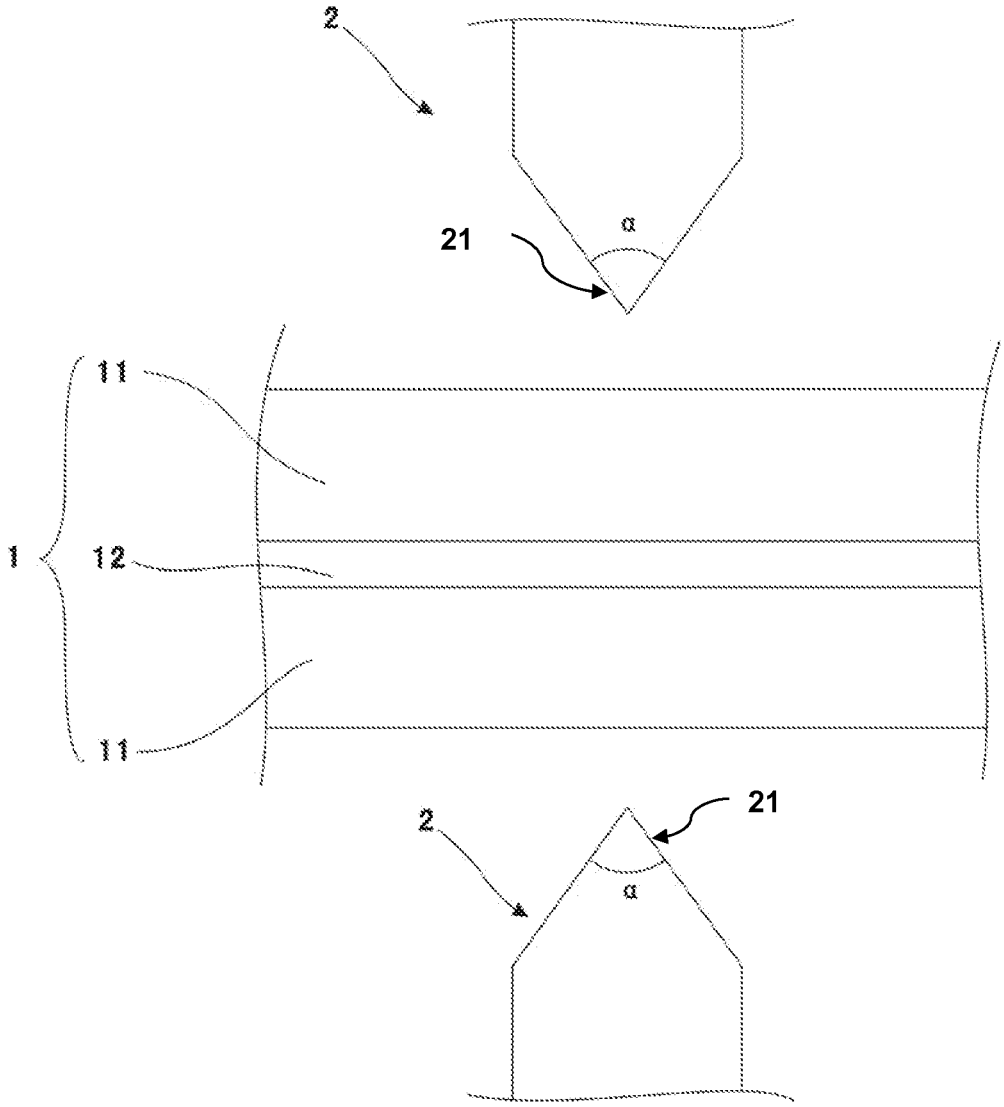
FIG. 2 shows a sectional view of the first and second cutting tools and the jigsaw puzzle board before the cutting process of cutting tools of the embodiment of the present invention.
Figure 3:
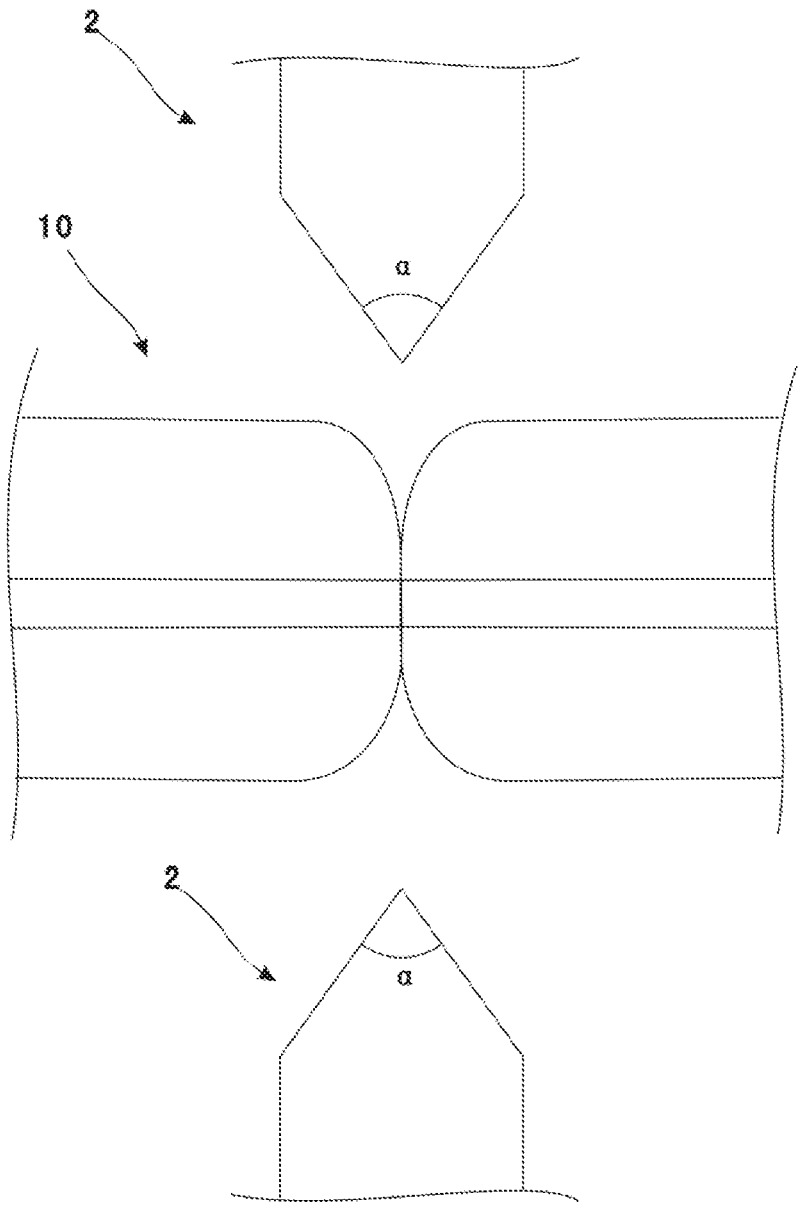
FIG. 3 shows a sectional view of the first and second cutting tools and the jigsaw puzzle board after the cutting process of cutting tools of the embodiment of the present invention.

In FIGS. 1 to 3, the puzzle of the embodiment for the present invention comprises a plurality of jigsaw puzzle elements or jigsaw puzzle pieces 10 which is formed from jigsaw puzzle board 1 through a cutting process. Preferably, both side edges of the said jigsaw puzzle elements 10 or jigsaw puzzle pieces are of curved faces. It is convenient for the user to assemble the jigsaw puzzle elements 10 or jigsaw puzzle pieces together and to avoid causing injury due to sharp edges appearing on the side edges of the jigsaw puzzle elements 10 or jigsaw puzzle pieces.

In order to ensure that both side edges of the jigsaw puzzle elements 10 or jigsaw puzzle pieces are of curved faces, the present invention provides a manufacturing method for making the puzzle of the present invention. As shown in FIGS. 2 and 3, two groups of cutting tool 2 or the first and second cutting tools are arranged at opposing faces of the jigsaw puzzle board 1 symmetrically. Two groups of cutting tool 2 or the first and second cutting tools move towards and backwards against the opposing faces of the jigsaw puzzle board 1 to pressure and cut the jigsaw puzzle board 1, forming a plurality of jigsaw puzzle element 10 or jigsaw puzzle pieces. Through two groups of cutting tools 2 are respectively pressed toward opposing sides of the jigsaw puzzle board 1, and because of the pressure delivered by the side edge 21 of the cutting tools 2 (i.e. the side edges formed on the jigsaw puzzle element 10 through the pressure cutting process or cutting process) are bent inwardly to form curved faces or arc portions. Further, the cutting tools 2 respectively perform pressure cutting on opposing sides of the jigsaw puzzle board 1 such that the side edges of the opposing sides of the jigsaw puzzle elements 10 or jigsaw puzzle pieces are made as curved faces or arc portions. Therefore, it is much safer to implement the present invention and avoids the user being cut by the sharp edges of the jigsaw puzzle elements 10 or jigsaw puzzle pieces. In addition, two groups of cutting tool 2 or the first and second cutting tools 2 perform pressure cutting in opposite direction. During the pressure cutting process, there shall always be a space between the cutting edges of the first and second cutting tools 2 during the pressure cutting process on the jigsaw puzzle board 1. The range of the said space is between 0.02 mm and 0.2 mm. During the pressure cutting process through the first and second cutting tools, the pressure cutting member 11 of the jigsaw puzzle board 1 is cut and the first portion of the fracturing member 12 is also cut. The second portion of the said fracturing member 12 has a thickness between 0.02 mm and 0.2 mm. The edge angle $\alpha$ of the cutting edge of the first cutting tool 2 has a substantially linear relationship with the angle of the arc portion of the side edge face of the jigsaw puzzle element 10 or jigsaw puzzle piece, the edge angle $\alpha$ of the cutting edge of the second cutting tool 2 has a substantially linear relationship with the angle of the arc portion of the side edge face of the jigsaw puzzle element 10 or jigsaw puzzle piece. That is, the larger the edge angle $\alpha$ is, the larger the angle of the curved face or the arc portion of the side edge face of the jigsaw puzzle element 10 or jigsaw puzzle piece is. Preferably, the diameter of the arc portion of the jigsaw puzzle element 10 or jigsaw puzzle piece or the curved face is between 1 mm and 3 mm.

Preferably, in order to make the edges on the side edges of opposing sides of the jigsaw puzzle element 10 or jigsaw puzzle piece be more round and smooth, a region between the side edge of the first and second cutting tools 2 and the body of the first and second cutting tools 2 comprises a concave curved face, an arc portion of the said side edge of the first and second cutting tools 2 corresponds with the side edge face of the jigsaw puzzle element 10 or jigsaw puzzle piece.

To avoid wear of cutting edges of the cutting tools 2 caused by the cutting edges of the two groups of cutting tool 2 being contacted each other during the pressure cutting process or cutting process, there shall always be a space between the cutting edges 21 or the ends of two groups of cutting tools during the pressure cutting process on the jigsaw puzzle board 1. Preferably, the cutting edges of the two groups of the cutting tool 2 may perform cutting operation on the corresponding positions of opposing faces of the jigsaw puzzle board. For the middle layer of the jigsaw puzzle board 1, the portion which is not pressured and cut may separate into a plurality of jigsaw puzzle elements 10 through fracturing. In order that this portion is convenient to be fractured, as shown in FIG. 2, the jigsaw puzzle board 1 thickness-wisely covers two pressure cutting layers 11 and the fracturing member 12 in the middle of two pressure cutting layers 11. Two groups of cutting tool 2 or the first and second cutting tools respectively cut the corresponding pressure cutting layer 11 or wood layer and then break up the fracturing member 12, it allows that the jigsaw puzzle elements 10 or jigsaw puzzle piece are separated with each other. The fracturing member 12 is located thickness-wisely in the middle of the jigsaw puzzle element 10, it avoids the user being cut by the sharp edges of jigsaw puzzle element 10 or jigsaw puzzle piece and is safe in use. During fabrication, it is enough to cut the pressure cutting layer 11 or wood layer by using cutting tool 2. The fracturing member 12 may be broken up by the user during operation.

Preferably, the pressure cutting layer 11 or wood layer is made of wood and the fracturing member 12 is made of a paperboard or paper. Relatively, the paperboard or the paper layer is more easily to be fractured such that the jigsaw puzzle board 1 is more easily divided into a plurality of jigsaw puzzle elements 10 or jigsaw puzzle pieces after the pressure cutting process or the cutting process and further, the paper layer or paperboard of the fracturing member will not cause injury to the user during operation. Preferably, the opposing faces of the jigsaw puzzle elements 10 are printed with patterns or words. The patterns or words on the opposing faces of at least two adjacent jigsaw puzzle elements 10 can correspond with each other, forming a continuous pattern or word. Besides, the paperboard layer is easy to be fractured than the wood layer. Therefore, during the pressure cutting process, unlike the wood layer, wood chips will not come out from the paperboard layer at the time of separation during the pressure cutting process. It is possible that the wood chips will be attached on the portions of the wood layer which are cut by the cutting tools 2. It actually causes inconvenience and danger to the users. Preferably, the fracturing member 12 is arranged at the middle of the jigsaw puzzle elements. The first pressure cutting member is arranged above the fracturing member and the second pressure cutting member is arranged below the fracturing member, the first and second cutting members both comprise at least one pressure cutting layer. The at least one pressure cutting layer is made of wood or plastic or other flexible material, i.e. the wood layer. Preferably, the said wood layer is made of plywood, i.e. the plywood layer. Alternatively, the pressure cutting layer is made of plastic and the fracturing member is made of paper or other material that is easy to be fractured, i.e. paperboard or paper layer. Typically, the paperboard or the paper layer is made of paper with a thickness between 0.2 mm and 1 mm. Of course, the fracturing member 12 would be made of the other materials which are easily fractured for the purpose of easy packaging; it further allows the user to memorize the patterns shown on both sides of the jigsaw puzzle before implementation of the present invention. As such, it shall be at least two fracturing members of the two jigsaw puzzle elements being mounted together such that the user only need to break up the paper-made fracturing member in order to divide the jigsaw puzzle board into a plurality of jigsaw puzzle elements. Conveniently, the mounting region of the aforesaid fracturing member 12 that remains un-cut after the first and second pressure cutting members 11 and a portion of the fracturing member 12 are cut by the first and second cutting tools 2, has a remaining thickness between 0.02 mm and 0.2 mm. The pressure cutting layer 11 or wood layer may be made of plastic similar materials. Preferably, the first pressure cutting member has a thickness substantially equal to that of the said second pressure cutting member. Furthermore, the grain patterns of two wood layers within the first or second pressure cutting member are alternatively arranged. Preferably, the first or second pressure cutting members further comprises at least two plywood layers or pressure cutting layers or wood layers, the grain patterns of the at least two plywood layers or pressure cutting layers or wood layers are alternatively arranged, the grain pattern of the at least two plywood layers is arranged in relatively different directions in order to enhance structural strength of the first pressure cutting member or the second pressure cutting member of the jigsaw puzzle element. Advantageously, due to the result of the grain patterns arranged in relatively different directions, two wood layers are combined in the first or second pressure cutting member for the purpose to further enhance the structural strength of the jigsaw puzzle element 10 or jigsaw puzzle piece. Alternatively, the first or second pressure cutting member comprises one wood layer. And the said one wood layer of the first pressure cutting member and that of the second pressure cutting member are arranged with grain pattern in relatively different directions to enhance the structural strength of the jigsaw puzzle elements 10 or jigsaw puzzle pieces. On the other hand, the opposing faces of the jigsaw puzzle elements comprise patterns. The patterns of at least two adjacent jigsaw puzzle elements or jigsaw puzzle pieces can match up with each other, forming a continuous pattern. The side edges faces of upper and lower faces of the jigsaw puzzle elements 10 or jigsaw puzzle pieces are of curved faces. The diameter of the side edge face R is preferably between 1 mm and 3 mm (see FIG. 3). Typically, the side edge faces of the jigsaw puzzle elements 10 or jigsaw puzzle pieces are of curved faces or have arc portions which increase the level of difficulties for the user to identify the front and rear sides of the jigsaw puzzle element 10 or jigsaw puzzle piece. Through assembling different printed patterns of the puzzle, the jigsaw puzzle elements 10 or jigsaw puzzle pieces will be provided with levels of difficulties of assembling, with more pleasure in implementation of the present invention.

The present invention has been described in detail, with reference to the preferred embodiment, in order to enable the reader to practice the invention without undue experimentation. However, a person having ordinary skill in the art will readily recognize that many of the previous disclosures may be varied or modified somewhat without departing from the spirit and scope of the invention. Accordingly, the intellectual property rights to this invention are defined only by the following claims.

The invention claimed is:

1. A puzzle comprising:

at least two jigsaw puzzle elements;

each jigsaw puzzle element comprises a first pressure cutting member, a second pressure cutting member, and a fracturing member made of a material different than said first and second pressure cutting members and which is arranged between said first and second pressure cutting members, and said first and second pressure cutting members being mounted to opposing surfaces of said fracturing member, wherein said fracturing members of said at least two jigsaw puzzle elements are interconnected to each other defining a mounting region and holding said at least two jigsaw puzzle elements together until a user fractures the fracturing members to form individual jigsaw puzzle elements to play with the puzzle, wherein said first and second pressure cutting members both comprise at least one pressure cutting layers, and wherein said first or second pressure cutting member comprises at least two pressure cutting layers, the directions of grain patterns of the at least two pressure cutting layers are arranged in relatively different directions, and wherein said fracturing member is made of paper, and said pressure cutting layer is made of wood.

2. The puzzle according to claim 1, wherein the said press cutting layer is made of plywood.

3. The puzzle according to claim 1, wherein the said fracturing member has a thickness between 0.2 mm and 1 mm.

4. A puzzle comprising:

at least two jigsaw two jigsaw puzzle elements;

each jigsaw puzzle element comprises a first pressure cutting member, a second pressure cutting member, and a fracturing member made of a material different than said first and second pressure cutting members and which is arranged between said first and second pressure cutting members, and said first and second pressure cutting members being mounted to opposing surfaces of said fracturing member, wherein said fracturing members of said at least two jigsaw puzzle elements are interconnected to each other defining a mounting region and holding said at least two jigsaw puzzle elements together until a user fractures the fracturing members to form individual jigsaw puzzle elements to play with the puzzle, wherein said first and second pressure cutting members both comprise at least one pressure cutting layers, and wherein said first or second pressure cutting member comprises at least two pressure cutting layers, the directions of grain patterns of the at least two pressure cutting layers are arranged in relatively different directions, and wherein either said fracturing member or said pressure cutting layer is made of plastic.

5. The puzzle according to claim 3, wherein said mounting region of the said fracturing member has a thickness between 0.02 mm and 0.2 mm.

6. A manufacturing process for the puzzle according to claim 1, wherein the method comprises the steps of: using first and second cutting tools; arranging the said first and second cutting tools at two opposite positions towards two opposing faces of a jigsaw puzzle board; and allowing the said first and second cutting tools to move towards and backwards with each other in order to cut off the said jigsaw puzzle board into a plurality of jigsaw puzzle elements during the cutting process.

7. The manufacturing process for the puzzle according to claim 6, wherein a space is arranged between cutting edges of the said first and second cutting tools during the cutting process.

8. The manufacturing process for the puzzle according to claim 7, wherein the said first and second cutting tools are adapted to cut off two opposing portions of the said jigsaw puzzle board, the length of the said space is between 0.02 mm and 0.2 mm, the said pressure cutting member of the said jigsaw puzzle board and a first portion of the said fracturing member are being cut off during the cutting process made by the said first and second cutting tools, a second portion of the said fracturing member has a thickness between 0.02 mm and 0.2 mm.

9. The manufacturing process for the puzzle according to claim 6, wherein the said pressure cutting members and the said fracturing member are arranged in a thickness-wise direction, the said first and second cutting tools are adapted to cut off the said first and second press cutting members into a plurality of the said jigsaw puzzle elements.

10. The manufacturing process for the puzzle according to claim 6, wherein the angle of the said cutting edge of the said first or second cutting tool has a substantially linear relationship with the angle of the said arc portion of the said jigsaw puzzle element.

11. The manufacturing process for the puzzle according to claim 10, wherein the side edge of the said first and second cutting tools of the said first or second cutting tool has a concave curved face which is adapted to coordinate with the said side edge face of the said jigsaw puzzle element.

12. The puzzle according to claim 1, wherein the said first pressure cutting member has substantially the same thickness as the said second pressure cutting member, the said jigsaw puzzle element comprises patterns being arranged on the opposing faces of the said jigsaw element, at least two of the said jigsaw puzzle elements having two corresponding patterns adapted for forming a continuous pattern.

13. A puzzle comprising:

at least two jigsaw puzzle elements;

each jigsaw puzzle elements comprises a first pressure cutting member, a second pressure cutting member, and a fracturing member made of a material different than said first and second pressure cutting members and which is arranged between said first and second pressure cutting members, and said first and second pressure cutting members being mounted to opposing surfaces of said fracturing member, wherein said fracturing members of said at least two jigsaw puzzle elements are interconnected to each other defining a mounting region and holding said at least two jigsaw puzzle elements together until a user fractures the fracturing members to form individual jigsaw puzzle elements to play with the puzzle;

wherein said first and second pressure cutting members both comprise at least one pressure cutting layer;

wherein said fracturing member is made of paper, and said pressure cutting layer is made of wood; and wherein the said pressure cutting layer of the said first pressure cutting member has substantially the same direction of the grain pattern as the direction of the grain pattern on the said pressure cutting layer of the second pressure cutting member.

14. The puzzle according to claim 1, wherein an arc portion of the said jigsaw puzzle element is arranged on a side edge face of the said jigsaw puzzle element, the diameter of the said arc portion is between 1 mm and 3 mm.

15. The puzzle according to claim 14, wherein the said arc portions are arranged on the two side edge faces of the opposing faces of the said jigsaw puzzle elements.

* * * * *